United States Patent [19]

Becker et al.

[11] 4,406,583

[45] Sep. 27, 1983

[54] CENTRIFUGAL PUMP WITH DOUBLE VOLUTE CASING

[75] Inventors: Karl-Heinz Becker, Worms; Peter Milla, Beindersheim; Peter Hergt, Ludwigshafen; Heinz-Dieter Hellmann, Grünstadt, all of Fed. Rep. of Germany

[73] Assignee: Klein, Schanzlin & Becker Aktiengesellschaft, Frankenthal, Fed. Rep. of Germany

[21] Appl. No.: 225,007

[22] Filed: Jan. 14, 1981

[30] Foreign Application Priority Data

Jan. 19, 1980 [DE] Fed. Rep. of Germany ..... 3001868

[51] Int. Cl.[3] ..... F01D 25/24; F04D 1/00; F04D 29/40

[52] U.S. Cl. ..... 415/219 C; 415/101; 415/207

[58] Field of Search ..... 415/93, 98, 99, 101, 415/184, 187, 198.1, 206, 207, 219 A, 219 B, 219 C; 416/184

[56] References Cited

FOREIGN PATENT DOCUMENTS 2640866 6/1977 Fed. Rep. of Germany .

*Primary Examiner*—Philip R. Coe
*Assistant Examiner*—Timothy F. Simone
*Attorney, Agent, or Firm*—Kontler, Grimes & Battersby

[57] ABSTRACT

A centrifugal pump comprises a casing which has two volutes disposed substantially diametrically opposite each other in such a way that the end of the first volute is adjacent to the start of the second volute. The outer diameter of the casing approximates or equals the diameter of the first volute in the region of the end of the first volute. This contributes to compactness of the casing. The volutes surround a rotary impeller or a guide wheel which is installed in the casing downstream of the impeller. Each volute extends along an arc of at most 180 degrees. The casing can have one or more elongated channels extending from the end of the first volute, along the second volute, and to a common outlet nozzle for both volutes.

15 Claims, 5 Drawing Figures

CENTRIFUGAL PUMP WITH DOUBLE VOLUTE CASING

BACKGROUND OF THE INVENTION

The present invention relates to centrifugal pumps in general, and more particularly to improvements in centrifugal pumps having volute casings. Still more particularly, the invention relates to improvements in centrifugal pumps with double volute casings.

The casing or housing of a pump serves to seal the conveyed fluid from the surrounding area. This can be achieved independently of the exact shape of the casing. However, and in order to be capable of carrying out certain specific tasks, the casings of centrifugal pumps normally assume one of a large number of different shapes which enable them to perform given functions more satisfactorily than centrifugal pumps having casings of a different configuration. Double volute casings are one of a large category of pump casings which can be used in centrifugal pumps, and their function is to balance the radial thrust. The two volutes are disposed opposite and are normally similar to one another. As a rule, the starts of the two volutes are offset 180 degrees in relation to each other. Such design is believed to ensure that the radial thrust is not only constant but also that the radial thrust is small or negligible within the entire operating range of the centrifugal pump. Depending on the structural design of the centrifugal pump, the volutes surround the impeller which is rotatably mounted in the casing, or they surround a guide wheel or diffuser which is installed in the pump casing downstream of the impeller.

German Offenlegungsschrift No. 26 40 866 discloses a centrifugal pump whose casing has two volutes which are offset relative to one another. The first volute extends beyond the start of the second volute and the casing has channels which connect the end of the first volute with the outlet nozzle. The latter is common to both volutes. A drawback of such centrifugal pumps is that the casing is relatively large owing to the dimensions of the volutes, as considered radially of the casing. This entails greater pressures and results in greatly increased bulk of the casing, especially when compared with a single volute casing.

OBJECTS AND SUMMARY OF THE INVENTION

An object of the present invention is to provide a novel and improved double volute casing for use in centrifugal pumps.

Another object of the invention is to provide a double volute casing whose dimensions are a fraction of the dimensions of equally rated conventional double volute casings.

A further object of the invention is to provide a centrifugal pump which embodies a double volute casing of the above outlined character.

An additional object of the inventon is to provide a compact and lightweight double volute casing which is just as satisfactory as heretofore known more expensive, bulkier and heavier double volute casings.

A further object of the invention is to provide a double volute pump casing which is constructed and assembled in such a way that its compactness cannot adversely influence the operation of the centrifugal pump wherein the casing is put to use.

Still another object of the invention is to provide a double volute casing whose outer diameter is smaller than the outer diameters of similarly rated double volute casings of presently known design.

The invention is embodied in a centrifugal pump which comprises a casing having first and second volutes. In accordance with a feature of the invention, each of the volutes extends along an arc of maximally 180 degrees, the start of the second volute is adjacent to the end of the first volute (i.e., the volutes are located substantially diametrically opposite each other if each extends along an arc of approximately 180 degrees), and the outer diameter of the casing at least approximates (i.e., it need not appreciably exceed) the outer diameter of the first volute in the region of the end of such first volute.

The volutes can surround an impeller which is rotatably mounted in the casing, or a guide wheel or diffuser which is mounted in the casing downstream of the impeller. The dimensions of the second volute may but need not approximate or equal the dimensions of the first volute.

The casing is further provided with an outlet nozzle and such outlet nozzle may be common to both volutes. In such pumps, the casing may be provided with at least one channel which extends from the end of the first volute, along the second volute and to the outlet nozzle, i.e., both volutes can discharge into one and the same outlet nozzle. The channel or channels between the end of the first volute and the outlet nozzle can have a substantially constant cross section. Alternatively, the cross section of at least one such channel can vary (either along the full length of the channel or along a certain portion of the channel) in a direction from the end of the first volute toward the outlet nozzle. If the casing has two channels, they may be mirror symmetrical to each other. The two channels (which need not be mirror symmetrical to each other) can flank the second volute, i.e., the latter can be disposed between the two channels.

If the impeller of the centrifugal pump is installed downstream of the volutes, the casing may be provided with channel means for delivery of fluid from the ends of the volutes to the impeller. The just mentioned channel means may comprise a plurality of channels and at least one of these channels may be an arcuate channel having a radius of curvature which is less (e.g., appreciably less) than the radius of the periphery of the casing.

The novel features which are considered as characteristic of the invention are set forth in particular in the appended claims. The improved centrifugal pump itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 2:
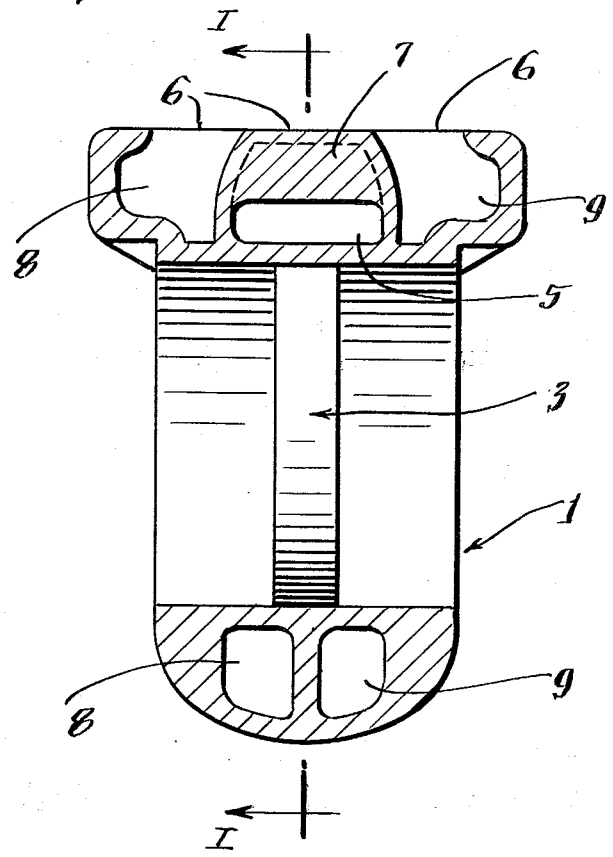
FIG. 2 is a sectional view as seen in the direction of arrows from the line II—II of FIG. 1.
Figure 1:
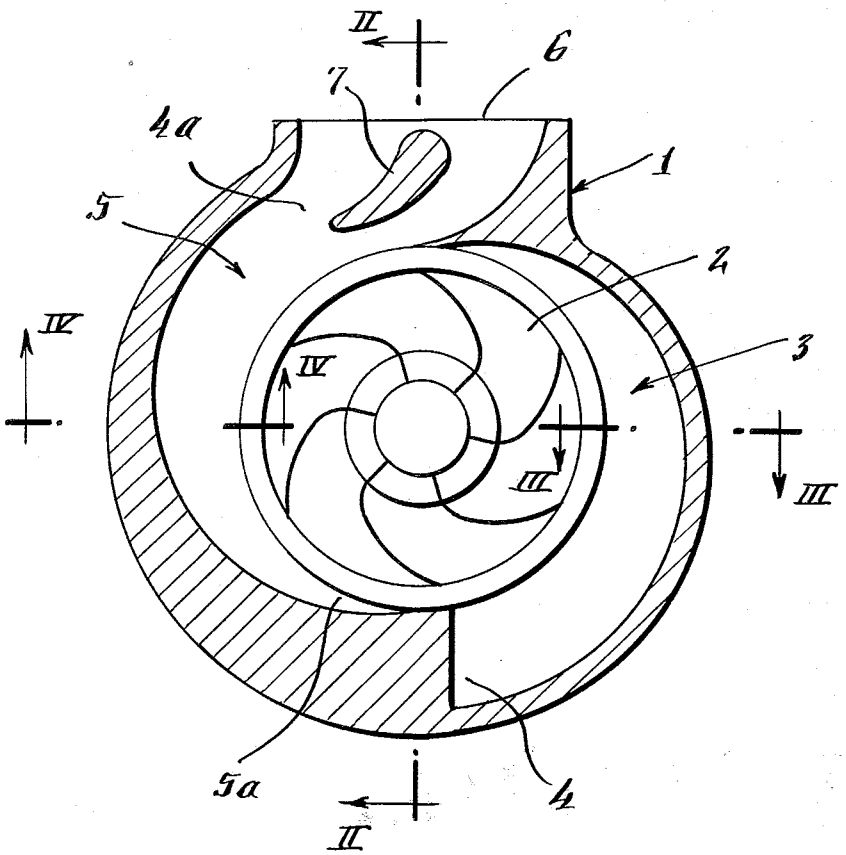
FIG. 1 is a transverse sectional view of the casing of a centrifugal pump wherein the two volutes surround a rotary impeller, the section being taken along the line I—I of FIG. 2 as seen in the direction of the arrows.

The centrifugal pump which is shown in FIGS. 1 to 4 comprises a double volute pump casing or housing 1 and an impeller 2 which is rotatably mounted in the casing and is surrounded by two arcuate volutes 3 and 5. These volutes are disposed diametrically opposite each other and are of similar or identical size and shape. Each of the volutes 3 and 5 extends along an arc of not more than 180 degrees (such arc can be less and even substantially less than 180 degrees). The end 4 of the first volute 3 is adjacent to the start 5*a* of the second volute 5, and the start of the first volute 3 is adjacent to the end 4*a* of the second volute 5. The illustrated casing 1 has a common outlet nozzle or discharge nozzle 6 for both volutes. The nozzle 6 contains a stationary guide rib 7 serving to enhance the outflow of pressurized fluid from the casing 1.

FIG. 2 shows that the fluid which issues from the first volute 3 flows into two arcuate channels 8 and 9 of the casing 1. These channels extend from the end 4 of the first volute 3, along the second volute 5, and to the outlet nozzle 6 of the casing 1. The means for connecting the outlet nozzle 6 with the fluid discharging nipple or with a next stage of the centrifugal pump is not shown in the drawing. The two channels 8 and 9 are mirror symmetrical to each other with reference to a vertical plane (as viewed in FIG. 2) which is disposed midway between such channels. It will be noted that the cross-sectional area of each of these channels varies in a direction from the end 4 of the first volute 1 toward the outlet nozzle 6. The variation may be constant from the inlet end and all the way to the outlet end of each channel, or such variation of the cross-sectional area can take place only along a portion of the channel 8 or 9. It is equally possible to utilize channels having uniform cross-sectional areas from end to end. Furthermore, the casing 1 can be formed with a single channel 8 or 9, or with more than two channels. The cross-sectional areas of the channels between the end 4 of the first volute 3 and the outlet nozzle 6 will be selected with a view to stabilize or uniformize hydraulic conditions in the volutes and/or in the outlet nozzle 6.

Figure 3:
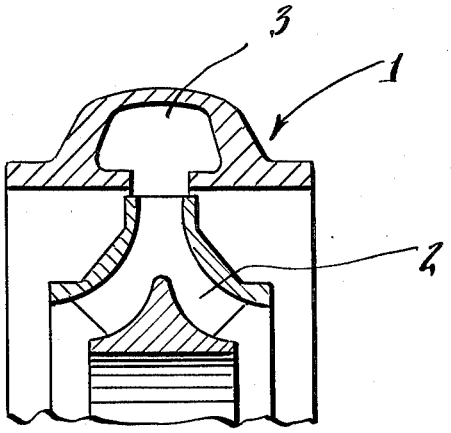
FIG. 3 is a fragmentary sectional view as seen in the direction of arrows from the line III—III of FIG. 1.
Figure 4:
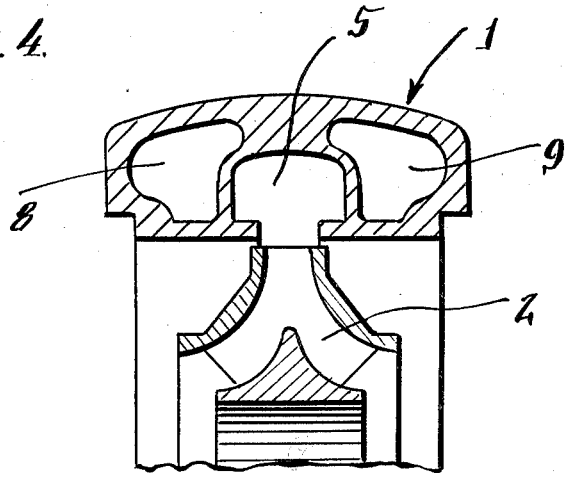
FIG. 4 is a fragmentary sectional view as seen in the direction of arrows from the line IV—IV of FIG. 1.

As shown in FIG. 3, the first volute 3 of the pump casing 1 receives fluid in response to rotation of the impeller 2. FIG. 4 shows that the median (developing) portion of the second volute 5 is flanked by the two arcuate channels 8 and 9. These two channels are at least substantially parallel to the volute 5. The fluid which leaves the end 4 of the first volute 3 flows through the channels 8, 9 and thence into the outlet nozzle 6 of the casing 1. The fluid which issues from the second volute 5 flows directly into the nozzle 6. The number of channels between the end 4 of the first volute 3 and the outlet nozzle 6 depends on the amount of fluid which is to be circulated by the centrifugal pump.

Figure 5:
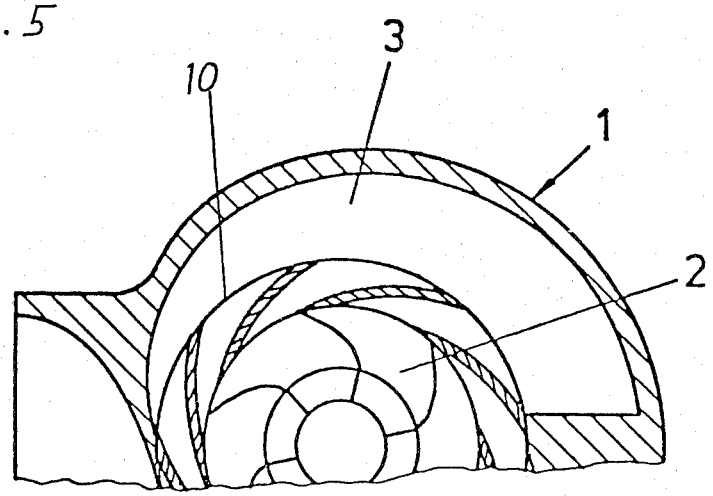
FIG. 5 is a partial transverse sectional view of the casing of another embodiment of a centrifugal pump.

FIG. 5 illustrates a guide wheel 10 mounted in the casing 1 downstream of the impeller 2 and surrounded by the volutes 3 and 5.

The outer diameter of the casing 1 is identical with or closely approximates the outer diameter of the first volute 3 in the region of the end 4. This contributes to compactness, lower weight and lower cost of the casing 1. Moreover, it is simpler to produce the improved compact casing in the form of a casting, and testing of the casing is simpler than the testing of conventional (bulkier) casings. Still further, the improved double volute casing is subjected to less pronounced stresses than the heretofore known double volute casings.

If desired, the centrifugal pump which embodies the present invention can be designed to have an impeller downstream of the volutes. The casing is then provided with one or more arcuate channels for delivery of fluid from the ends of the volutes to the impeller. The radii of curvature of such channels are smaller than the radius of the peripheral surface of the improved casing. Such construction can be resorted to when the centrifugal pump includes a second stage downstream of a double suction impeller.

The reduction of dimensions of the improved double volute casing is attributable to the feature that the outer diameter of the casing need not exceed the outer diameter of the end 4 of the first volute 3. Such reduction of dimensions entails a surprisingly large reduction of the weight of the casing 1.

The improved pump is susceptible of many further modifications without departing from the spirit of the invention. For example, the casing 1 or a similar double volute casing can have discrete outlet nozzles for the two volutes.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A centrifugal pump comprising a casing which is provided with a pair of volutes having starts and ends, each of said volutes extending along an arc of maximally 180 degrees, and said volutes being arranged so as to be free of overlap with one another, the outer diameter of said casing approximating or equalling the outer diameter of one of said volutes in the region of the end of said one volute.

2. The pump of claim 1, further comprising an impeller rotatably mounted in said casing, said volutes surrounding said impeller.

3. The pump of claim 1, further comprising an impeller rotatably mounted in said casing and a guide wheel mounted in said casing downstream of said impeller, said volutes surrounding said guide wheel.

4. The pump of claim 1, wherein the dimensions of the other volute at least approximate the dimensions of said one volute.

5. The pump of claim 1, wherein said casing has an outlet nozzle common to said volutes and at least one channel extending between the end of said one volute, along the other volute and to said outlet nozzle.

6. The pump of claim 5, wherein said channel has a substantially constant cross section all the way from the end of said one volute to said outlet nozzle.

7. The pump of claim 5, wherein the cross section of at least a portion of said channel varies in a direction from the end of said one volute toward said outlet nozzle.

8. The pump of claim 1, further comprising impeller means rotatably mounted in said casing, said casing having channel means for delivery of fluid from the ends of said volutes to said impeller means.

9. The pump of claim 8, wherein said channel means comprises a plurality of channels.

10. The pump of claim 8, wherein said channel means includes at least one arcuate channel and the radius of curvature of said channel is less than the radius of the periphery of said casing.

11. The pump of claim 1, wherein the end of said one volute is located adjacent the start of the other volute.

12. The pump of claim 11, wherein said casing has an outlet nozzle common to said volutes and a plurality of elongated channels extending from the end of said one volute, along the other volute and to said outlet nozzle.

13. The pump of claim 12, wherein said casing has two mirror symmetrical channels.

14. The pump of claim 12, wherein said casing has two channels and the other volute is disposed between said channels.

15. The pump of claim 1, wherein the start of said one volute is located adjacent the end of the other volute.

* * * * *